US005488934A

United States Patent [19]

Shirai et al.

[11] Patent Number: 5,488,934

[45] Date of Patent: Feb. 6, 1996

[54] VALVE GEAR DEVICE

[75] Inventors: Eiji Shirai, Nukata; Koji Hotta, Nagaya; Shinji Otsuka, Chiryu; Shigeru Katsuragi, Anjyo; Yoshiyuki Kawai; Hisashi Kodama, both of Nagaya, all of Japan

[73] Assignee: Aisin Seiki Kabushiki Kaisha, Kariya, Japan

[21] Appl. No.: 309,479

[22] Filed: Sep. 21, 1994

[30] Foreign Application Priority Data

| | | | |
|---|---|---|---|
| Sep. 22, 1993 | [JP] | Japan | 5-236646 |
| Jan. 28, 1994 | [JP] | Japan | 6-008765 |
| Jun. 29, 1994 | [JP] | Japan | 6-148287 |
| Jun. 30, 1994 | [JP] | Japan | 6-150144 |

[51] Int. Cl.[6] ..... F01L 13/00; F02D 13/06

[52] U.S. Cl. ..... 123/90.16; 123/198 F

[58] Field of Search ..... 123/90.15, 90.16, 123/90.17, 90.27, 90.48, 198 F

[56] References Cited

U.S. PATENT DOCUMENTS

| | | | |
|---|---|---|---|
| 4,770,137 | 9/1988 | Okabe et al. | 123/198 F |
| 5,090,364 | 2/1992 | McCarroll et al. | 123/90.16 |
| 5,287,830 | 2/1994 | Dopson et al. | 123/90.16 |
| 5,343,833 | 9/1994 | Shirai | 123/90.16 |
| 5,361,733 | 11/1994 | Spath et al. | 123/90.16 |
| 5,361,734 | 11/1994 | Shirai | 123/90.16 |

*Primary Examiner*—Weilun Lo

*Attorney, Agent, or Firm*—Burns, Doane, Swecker & Mathis

[57] ABSTRACT

A valve gear device includes a stem having one end and the other end, an intake and exhaust valve connected to the other end of the stem and serving for opening and closing a port formed in a cylinder block of an internal combustion engine, a first spring biasing the stem toward a closing condition of the intake and exhaust valve, a cam, and a valve control device interposed between the cam and one end of the stem, the valve control device having a first member fitted in the cylinder block so as to be slidable along an axis of the stem and engaged with the cam, a second member receiving one end of the stem and movable within the first member relative thereto and a regulating device for permitting and preventing the movement of the second member relative to the first member. Such a structure enables that the top end of the stem is out of sliding engagement with any of related members, thereby preventing a friction wear of the top end of the stem.

4 Claims, 16 Drawing Sheets

VALVE GEAR DEVICE

FIELD OF THE INVENTION

The present invention relates to a valve gear device, and in particular to a valve gear device for an internal combustion engine.

BACKGROUND OF THE INVENTION

In a conventional valve gear device such as that disclosed in U.S. Pat. No. 4,770,137 issued on Sep. 13, 1988, an intake and exhaust valve is secured to a stem which is movably supported in an engine block. A body is fitted in the block and a top end of the body is in engagement with a rotating cam so that the body is reciprocally movable in the vertical direction. In the body, a plunger is fitted so as to be movable in the horizontal direction. When a top end of the stem which is continually biased by a spring is in engagement with a plunger which is at its first position, the reciprocal movement of the body together with the plunger is established, thereby establishing reciprocal movement of each of the stem and the intake and exhaust valve. Thus, in accordance with the rotation of the cam, the intake and exhaust valve performs opening and closing operations.

In the foregoing structure, if a continual closed condition of the intake and exhaust valve is desired, the plunger is moved to its second position. Then, the stem is brought into disengagement with the plunger and is moved into the body by a biasing force of the spring so that the stem is not affected by the movement of each of the body and the plunger.

However, whenever the plunger moves, the plunger is in sliding engagement with the top end of the stem. As a result, frictional wear of the stop end of the stem is inevitable. Thus, with the passage of time, the lift quantity of the intake and exhaust valve unexpectedly and undesirably varies.

SUMMARY OF THE INVENTION

It is, therefore, an object of the present invention to provide a valve gear device without the foregoing drawbacks.

Another object of the present invention is to provide a valve gear device wherein a stem is in association with a plunger without friction.

In order to attain the foregoing objects, a valve gear device is comprised of a stem having one end and the other end; an intake and exhaust valve connected to the other end of the stem and serving for opening and closing a port formed in a cylinder block of an internal combustion engine; a first spring biasing the stem toward a closing condition of the intake and exhaust valve; a cam; and a valve control device interposed between the cam and one end of the stem. The valve control device includes a first member fitted in the cylinder block so as to be slidable along an axis of the stem and engaged with the cam, a second member receiving one end of the stem and movable within the first member relative thereto, and regulating means for permitting and preventing the movement of the second member relative to the first member.

BRIEF DESCRIPTION OF THE DRAWING FIGURES

The above and other objects, features and advantages of the present invention will be more apparent and more readily appreciated from the following detailed description of preferred exemplary embodiments of the present invention, considered in connection with the accompanying drawing figures in which like elements are designated by like reference numerals and wherein.

DETAILED DESCRIPTION OF PREFERRED EMBODIMENTS

Figure 1:
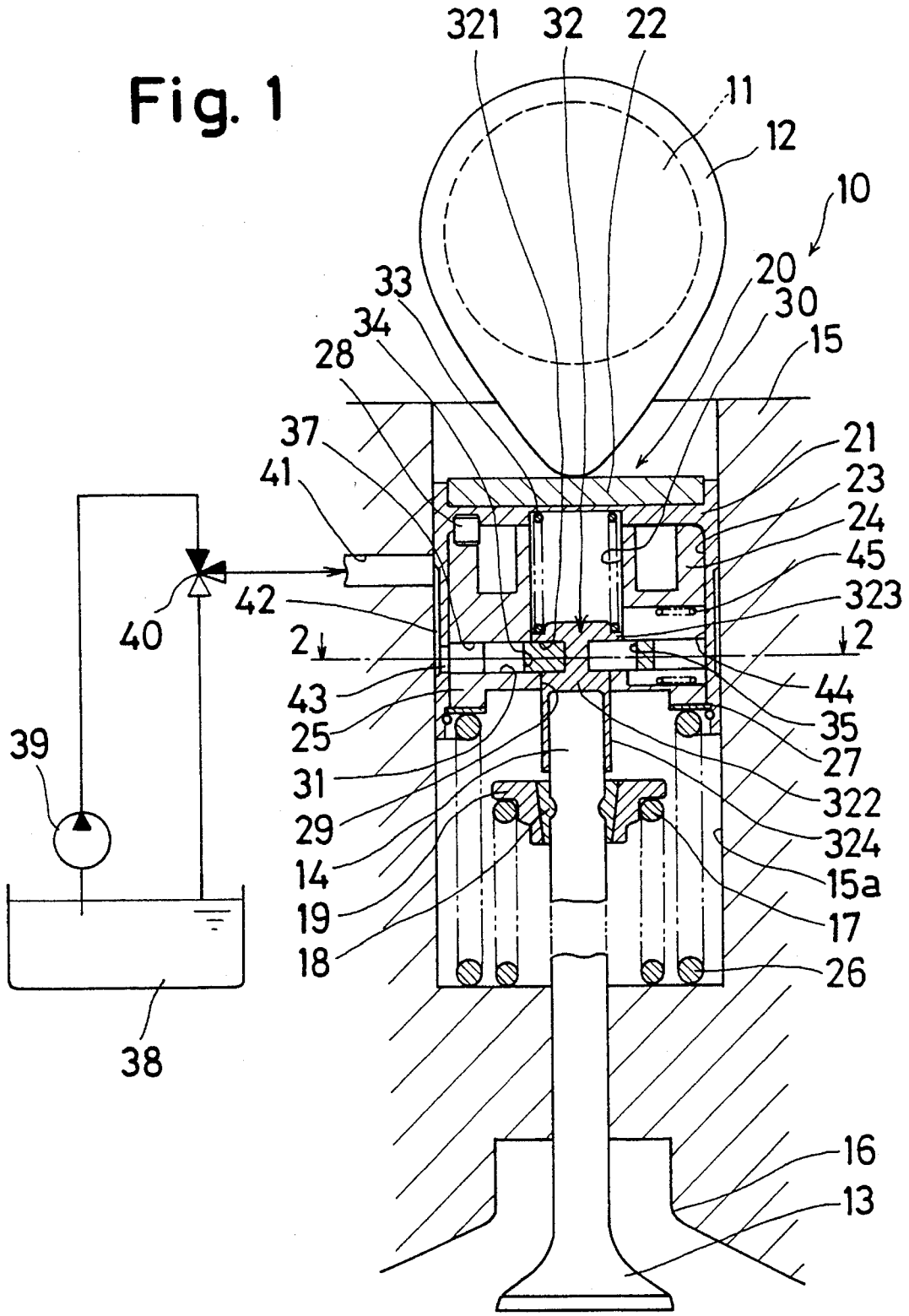
FIG. 1 is a cross-sectional view of a valve gear device in accordance with a first embodiment of the present invention.

Preferred embodiments of the present invention will be described below in detail with reference to the accompanying drawings.

Referring initially to FIGS. 1 through 5 which illustrate the features associated with a first embodiment of the present invention, an engine valve timing device 10 includes a cam shaft 11 which is provided thereon with a cam 12, an intake and exhaust valve 13 for opening and closing an intake port (not shown) and an exhaust port (not shown) of an engine by respectively resting on and moving away from a valve seat 16, a stem 14 which is secured to the valve 13, a first spring 17 for moving the stem 14, and a valve controller 20.

The first spring 17 moves the stem 14 toward a closing direction of the intake and exhaust valve 13 in such a manner that one end of the first spring 17 is engaged with a retainer 19 which is mounted on the stem 14 via a cotter 18. It is to be noted that the stem 14 is made of a heat-resistant material or substance such as heat-resistant steel. The valve controller 20, which constitutes a principal portion of the present invention, is disposed between the cam 12 and the stem 14.

A cylinder head 15 has formed therein a cylinder bore 15*a* which extends parallel to an axis of the stem 14 (the intake and exhaust valve 13). A slider body or outer body 21 is movably mounted in the cylinder bore 15*a*. An outer shim 22 in the form of an annular plate is provided on the slider body 21 in order to adjust the clearance between the cam 12 and the valve controller 20. The radius of the outer shim 22 is slightly less than the radius of the cylinder bore 15*a*.

In an inner space 23 of the slider body 21, a pair of axially arranged inner bodies 24, 25 are provided for being moved together with the slider body 21. The inner body 24 and the inner body 25 are sometimes hereinafter referred to as a first inner body 24 and a second inner body 25, respectively. Between the second inner body 25 and a bottom of the cylinder bore 15*a*, there is disposed or interposed a third spring 26 for urging the inner bodies 24 and 25 toward the outer body 21. The urging direction of the third spring 26 corresponds to the closing direction of the intake and exhaust valve 13. A spring retainer 27 is disposed between the third spring 26 and the second body 25.

The first body 24 is supported to the outer body 21 via a pin 28 and is prevented from being rotated relative thereto. A guide bore 29 which is coaxial with the axis of the stem 14 is formed in the second inner body 25. A guide bore 30 is also formed in the first inner body 24. The guide bore 30 is coaxial with the guide bore 29 and is greater in radius than the guide bore 29. In addition, a space or a bore 31 is defined between the inner bodies 24, 25. This space or bore 31 is perpendicular to the axis of the stem 14. The outer body 21, the first inner body 24 and the second inner body 25 constitute a whole body. One of the outer body 21, the first inner body 24 and the second inner body 25 can be formed integrally with one or more of the remaining elements.

A slider 32 is in sliding engagement with the guide bores 29, 30 and is urged by a fourth spring 33 toward an opening direction of the intake and exhaust valve 13. The biasing force of the fourth spring 33 is less than that of the first spring 17.

The slider 32 has a main portion 322 which is substantially H-shaped in cross-sectional configuration, an annular groove 321, a flange 323 and a stem guide 324. The annular groove 321 of the slider 32, which is opened toward a radially outward direction of the slider 32, is in alignment with the space 31 and is identical therewith in axial length.

The main portion 322 of the slider 32 is substantially identical with the guide bore 29 in radius and is in abutment with a top end of the stem 14. The flange 323 of the slider 32 extends outwardly therefrom in the radial direction and is substantially identical with the guide bore 30 in radius. The flange 323 of the slider 32 acts as a retainer for the fourth spring 33. The stem guide 324 of the slider 32, which is in the form of an annular wall, extends downwardly from the main portion 322. The inner radius of the stem guide 324 is slightly greater than the radius of the stem 14 and the outer radius of the stem guide 324 is substantially identical to the radius of the guide bore 29. Thus, a smooth axial movement of the stem 14 as well as a smooth axial movement of the stem guide 324 is achieved. It is to be noted that the slider 32 is made of a wear-resistant material or substance such as a dipped carbon material.

Figure 2:
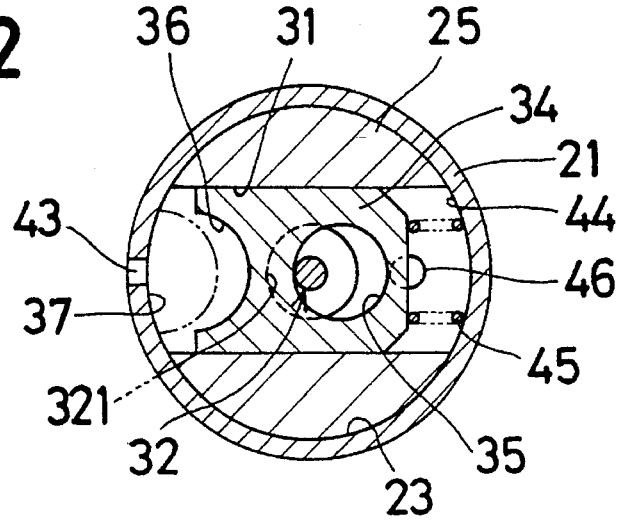
FIG. 2 is a cross-sectional view taken along the section line 2—2 in FIG. 1.

A plate 34 provided with a hole 35 is movably or slidably fitted in the space 31. The radius of the hole 35 permits the main portion 322 (stem guide 324) of the slider 32 to pass therethrough. As best seen in FIG. 2, a semi-circular notch 36 is formed at a left side of the plate 34. The plate 34 is movable between a first position shown in FIGS. 1 and 2, and a second position shown in FIGS. 3 and 4.

Figure 5:
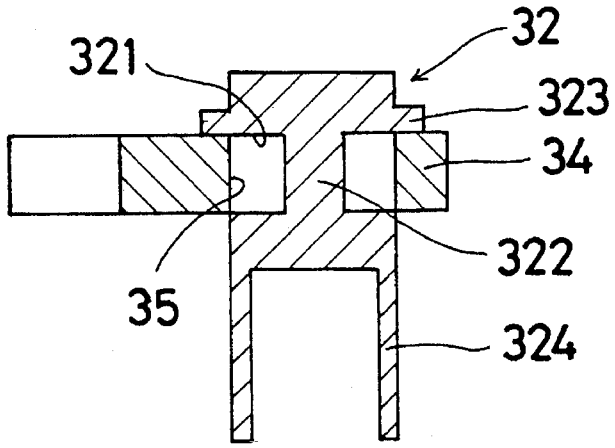
FIG. 5 shows a relationship between a slider and a plate.
Figure 3:
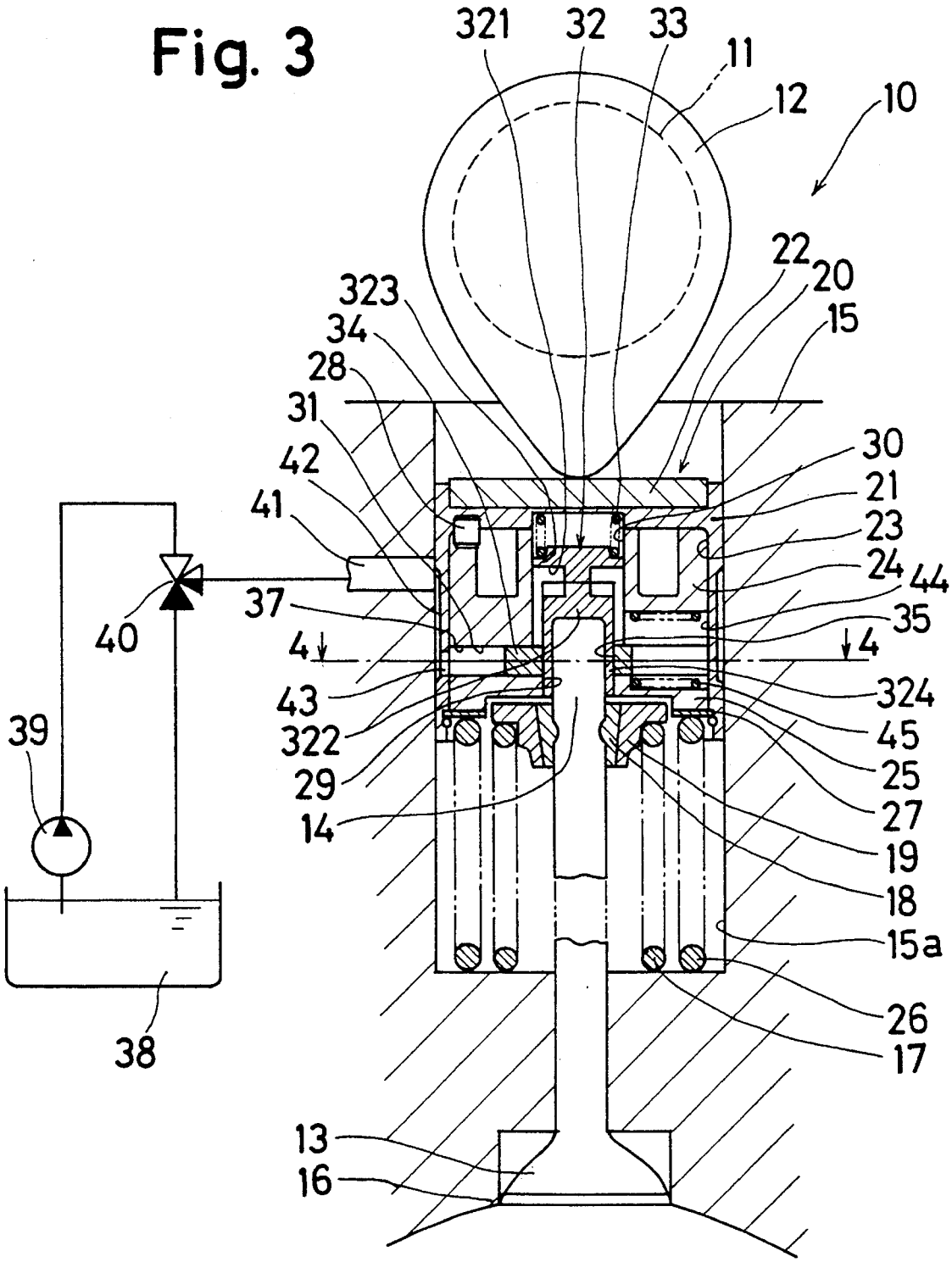
FIG. 3 is a cross-sectional view of the valve gear device shown in FIG. 1 wherein an intake and exhaust valve remains in its closed condition.

In the first position, the plate 34 is in engagement with the space 31 and the annular groove 321 of the slider 32, and the slider 32 and the stem 14 are prevented from being moved relative to the inner bodies 24 and 25. In the second position, the plate 34 is out of engagement with the annular groove 321 of the slider 32 and the hole 35 is aligned with the slider 32 as shown in FIG. 3, so that the slider 32 and the stem 14 become movable relative to the inner bodies 24 and 25. In addition, as shown in FIG. 5, the radius of the flange 323 of the slider 32 is greater than that of the hole 35 of the plate 34 so that when the plate 34 is at its second position the flange 323 rests on the plate 34. Thus, during transfer of the plate 34 from its first position to its second position, no confliction or interference is generated between the plate 34 and the slider 32. This means that a smooth movement of the plate 34 and positioning of the slider 32 relative to the plate 34 are established. A wear-resisting material or substance such as a dipped carbon material can be used as the raw material for the plate 34.

An oil chamber 37 is defined between a left end of the plate 34 and the outer body 21. The oil chamber 37 is supplied with fluid pressure by means of an oil pressure pump 39 from an oil pan or reservoir 38 via an electromagnetic switching valve 40, a passage 41 formed in the cylinder head 15, an annular groove 42 formed in the outer body 21, and a passage 43 formed in the outer body 21. The electromagnetic switching valve 40 is controlled by a controller or CPU (not shown) to which engine conditions are fed such as the engine rotation speed, the engine load and other factors, and depending on such engine conditions the fluid is supplied to the passage 41 (FIG. 1) or returned to the reservoir 38 (FIG. 3). The plate 34 is movable, due to the fluid pressure supplied to the oil chamber 37, from the second position (FIGS. 3 and 4) to the first position (FIGS. 1 and 2). It is to be noted that the fluid in the oil chamber 37 can be drained into the reservoir 38 via the passage 43, the groove 42, the passage 41 and the electromagnetic switching valve 40.

Figure 4:
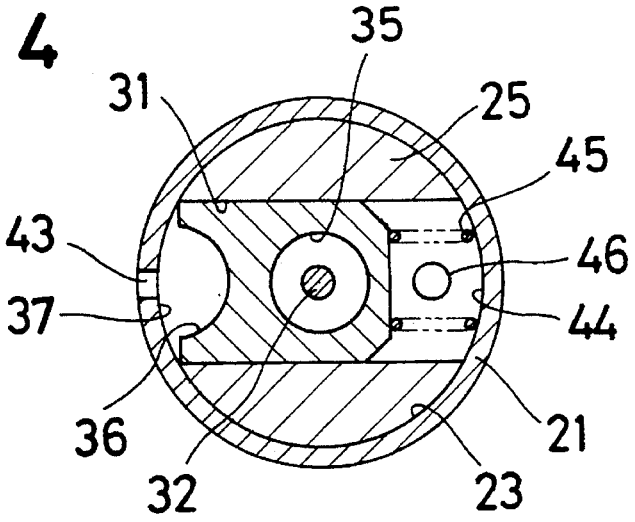
FIG. 4 is a cross-sectional view taken along the section line 4—4 in FIG. 3.

A spring chamber 44 is defined between a right end of the plate 34 and the outer body 21. A fifth spring 45 is provided within the spring chamber 44 to move the plate 34 such that the volume of the oil chamber 37 is decreased. The biasing force or spring constant of the fifth spring 45 is less than the fluid pressure within the oil chamber 37. When no fluid pressure is supplied in the oil chamber 37, the fifth spring 45 maintains the position of the plate 34 at its second position as shown in FIGS. 3 and 4. A drain passage 46 (see FIGS. 2 and 4) is formed in the second inner body 25 which is opened toward the spring chamber 44 in order that a small amount of fluid entering the spring chamber 44 from the oil chamber 37 is drained outside the valve controller 20.

It is to be noted that the movement of the plate 34 from its first position to its second position (from its second position to its first position) can be established by fluid pressure (the spring 45).

In operation, when engine operation is initiated, the cam shaft 11 and the cam 12 are brought into rotation. If it is desired that the intake and exhaust valve 13 be operated continually, the controller orders the electromagnetic switching valve 40 to establish the condition as shown in FIG. 1. Then, the pump 39 supplies fluid from the reservoir 38 to the oil chamber 37 via the passage 41, the groove 42 and the passage 43. The resultant fluid pressure moves the plate 34 from its second position (FIG. 4) to its first position (FIG. 2). Against the biasing force of the spring 45, a part of the plate 34 enters the groove 321 of the slider 32, and the plate 34 is ultimately stopped after being engaged with the main portion 322 of the slider 32 as shown in FIG. 1. Thus, the resultant position of the plate 34 prevents movement of the slider 32 relative to the outer body 21, the first inner body 24 and the second inner body 25.

Thus, as the rotation of the cam 12 proceeds, when the outer shim 22 is brought into engagement with a nose of the cam 12 instead of a centric or circular portion thereof, the outer body 21, the first inner body 24 and the second inner body 25 are moved in a downward direction together with the slider 32. That is, so long as the outer shim 22 is in engagement with the nose of the cam 12, the resultant force is transmitted to the intake and exhaust valve 13 via the outer body 21, the first inner body 24, the second inner body 25, the slider 32 and the stem 14, in that order. Depending on the shape of the nose or a profile of the cam 12, the intake and exhaust valve 13 is moved away from the seat 16 against the first spring 17 and intake operation or exhaust operation is established. At this time, even though the outer body 21 rotates relative to the cylinder bore 15*a*, the engagement between the cam 12 and the outer shim 22 remains unchanged. This is due to the annular shaped structure of the outer shim 22.

If it is desired that the intake and exhaust valve 13 not be operated while the cam 12 is being rotated, the controller orders the electromagnetic switching valve 40 to establish the condition as shown in FIG. 3. Then, the fluid in the oil chamber 37 is drained into the reservoir 38 via the passage 43, the groove 42, the passage 41 and the valve 40. Thus, due to the biasing force of the fifth spring 45, the plate 34 is transferred from its first position as shown in FIG. 2 to its second position as shown in FIG. 4. Under the second position of the plate 34, as shown in FIG. 4, a portion of the plate 34 is moved away from the groove 321 of the slider 32 and the hole 35 of the plate 34 is aligned with the stem 14 (slider 32). This resulting condition enables movement of the slider 32 relative to the outer body 21, the first inner body 24 and the second inner body 25.

Thus, even when the outer shim 22 is brought into engagement with the nose of the cam 12 instead of the centric or circular portion, the force from the cam 12 is transmitted to only the outer body 21, the first inner body 24 and the second inner body 25, and is not transmitted to the slider 32 and the stem 14. Thus, the slider 32 is urged in the upward direction due to the biasing force of the first spring 17 via the stem 14 such that the main portion 322 and the stem guide 324 are guided along the guide bore 29 and the hole 35 against the force of the spring 33. Also, the flange 323 of the slider 32 is guided along the guide bore 30 against the force of the spring 33. The result is that no force is transmitted from the cam 12 to the intake and exhaust valve 13 so that the closed condition of the intake and exhaust valve 13 is maintained and no operation of the intake and exhaust valve 13 occurs. Under such a condition, even though the outer body 21 rotates relative to the cylinder bore 15*a*, the engagement between the cam 12 and the outer shim 22 remains unchanged. This is due to the annular shaped structure of the outer shim 22.

As mentioned above, in accordance with the first embodiment of the present invention, the following advantages are realized.

1) The slider 32 engaged with the stem 14 in a coaxial manner is interposed between the stem 14 and the plate 34 which intersect one another perpendicularly, thereby avoiding contact between the stem 14 and the plate 34. Thus, the top end of the stem 14 is free from partial or uneven frictional wear over the passage of time. This enables an increase in the life of the stem 14.
2) The slider 32 and the plate 34 are made of a wear-resistant material, thereby restricting uneven wear of both the slider 32 and the plate 34 regardless of the movement of the plate 34 into and away from the annular groove 321 of the slider 32. Thus, despite long-term use, the lift quantity or ability of the intake and exhaust valve 13 remains unchanged.
3) When the plate 34 is at its second position as shown in FIGS. 3 and 4, the biasing force of the first spring 17 which moves the stem 14 in the upward direction is required to have a force for lifting only the stem 14 and the slider 32. This, makes the required biasing force of the first spring 17 considerably small.
4) The use of the plate 34 enables a decrease in the axial length or height of the valve controller 20.
5) The plate 34 is moved into and away from the annular groove 321 of the slider 32. The result is that even though the slider 32 is rotated relative to the outer body 21 and the inner bodies 24, 25, such movements of the plate 34 can be surely and reliably established. In addition, the width or axial length of the annular groove 321 of the slider 32 is substantially identical with the thickness or height of the plate 34, thereby preventing the plate 34 from rattling when the plate 34 moves into the annular groove 321.
6) The flange 323 of the slider 32 rests on the plate 34 continually as shown in FIGS. 1, 3, and 5, which enables interference between the slider 32 and the plate 34 upon movement thereof. Therefore, such movement can be established in a smooth manner. Such a structure prevents an extraction of the slider 32 from the plate 34 which is at its second position as shown in FIG. 5.
7) The stem guide 324 of the slider 32 can avoid or prevent interference of the top end of the stem 14 with the plate 34 or the second inner body 25. This makes it possible to prevent even wear of each of the stem 14, the plate 34 and the second inner body 25.
8) Since the outer shim 22 is formed with an annular configuration, even though the outer body 21 rotates relative to the cylinder bore 15*a*, the engagement between the cam 12 and the outer shim 22 remains unchanged. Thus, no device is required for preventing the rotation of the outer body 21 relative to the cylinder bore 15*a*.
9) The rotation of the first inner body 24 relative to the outer body 21 is prevented by the pin 28. This means that fluid communication between the oil chamber 37 formed in the body bore 31 and each of the groove 42 and the passage 43 formed in the outer body 21 cannot be interrupted.

A second embodiment of the present invention will be explained with reference to FIGS. 6 through 9. It is to be noted that the second embodiment is similar to the first embodiment in basic concept and therefore only the features of the second embodiment which differ from the first embodiment and which are required for a proper understanding of the second embodiment will be described.

Figure 6:
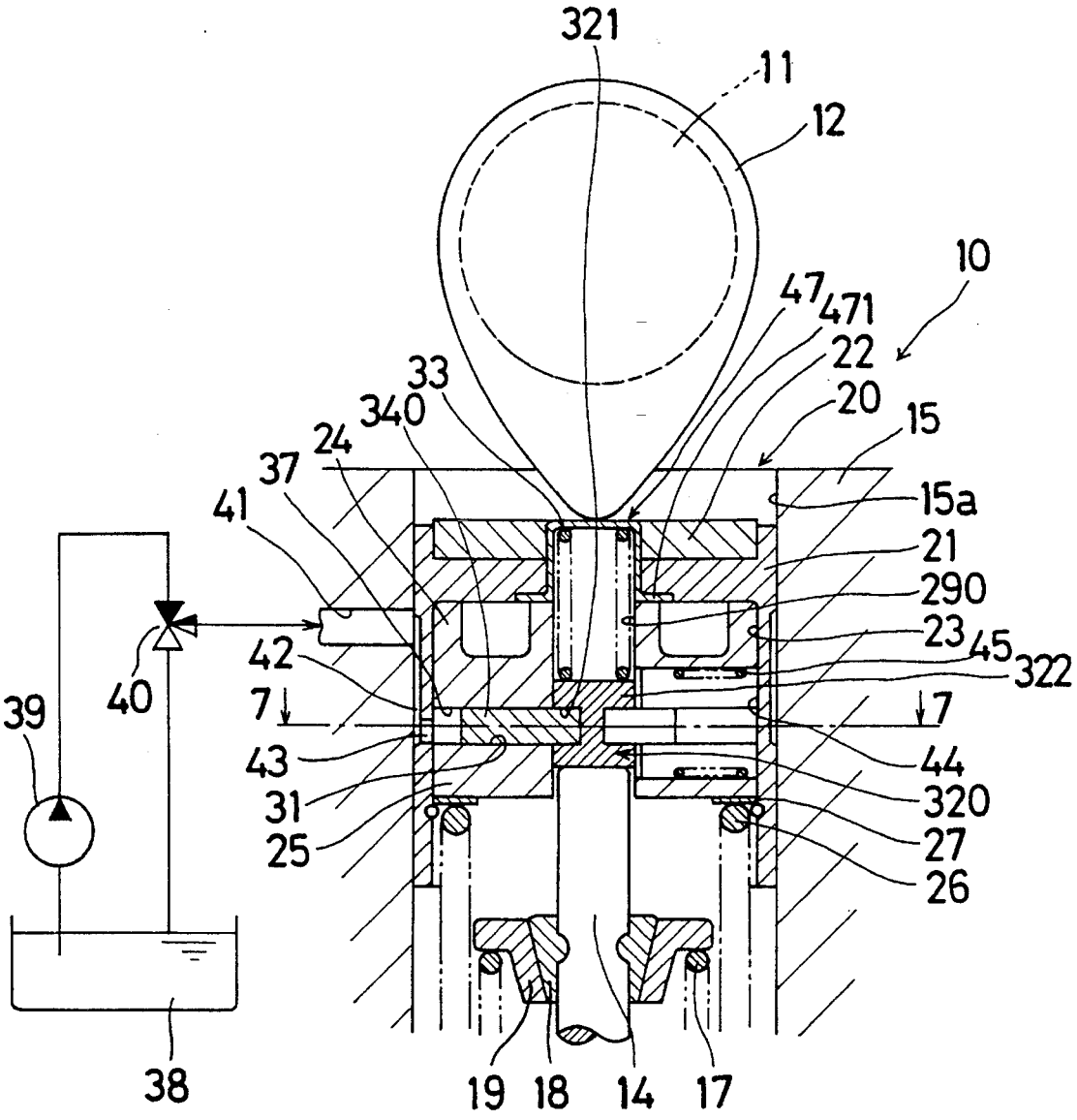
FIG. 6 is a cross-sectional view of a valve gear device in accordance with a second embodiment of the present invention.

In FIG. 6, a guide bore 290 is formed with respect to an outer body 21, an outer shim 22, a first inner body 24 and a second inner body 25. The guide bore 290 is similar to the guide bore 29 of the first embodiment. An upper end of the guide bore 290 is closed by a retainer 47 which is configured with a cylindrical blind bore. The retainer 47 is provided with an annular flange 471 which extends outwardly in the radial direction, and the flange 471 is fixedly held between the outer body 21 and the first inner body 24. Thus, an extraction or removal of the retainer 47 from the guide bore 290 is prevented.

Slidably mounted in the guide bore 290 is a slider 320 having a main portion 322 which possesses an H-shaped configuration. The largest diameter of the main portion 322 is substantially identical with that of the guide bore 290. A spring 33 is disposed between the slider 320 and the retainer 47 so that the slider 320 is urged toward an opening direction of the intake and exhaust valve 13. The top end of the retainer 47 passes through an outer shim 22 and is in line with the outer shim 22. It is to be noted that the slider 320, unlike the slider 32 of the first embodiment, is not provided with a flange and a stem guide.

Figure 7:
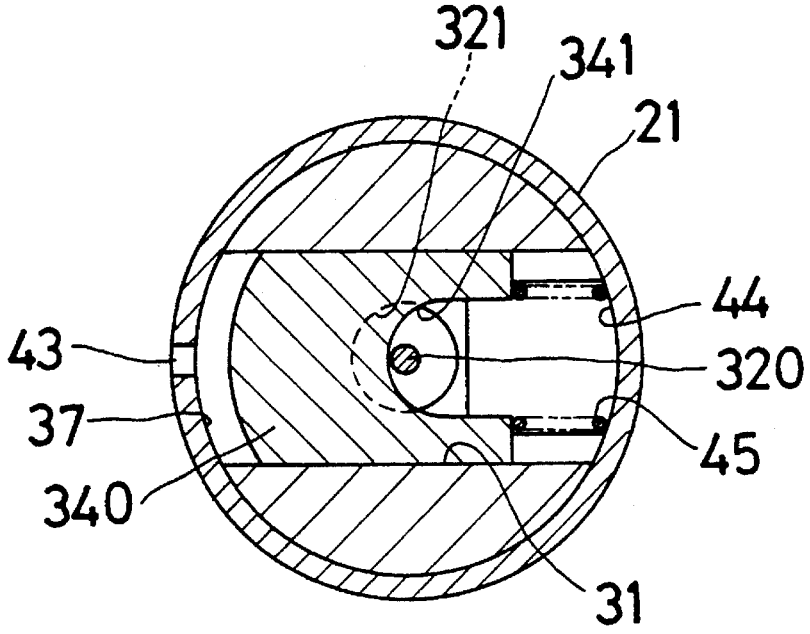
FIG. 7 is a cross-sectional view taken along the section line 7—7 in FIG. 6.
Figure 9:
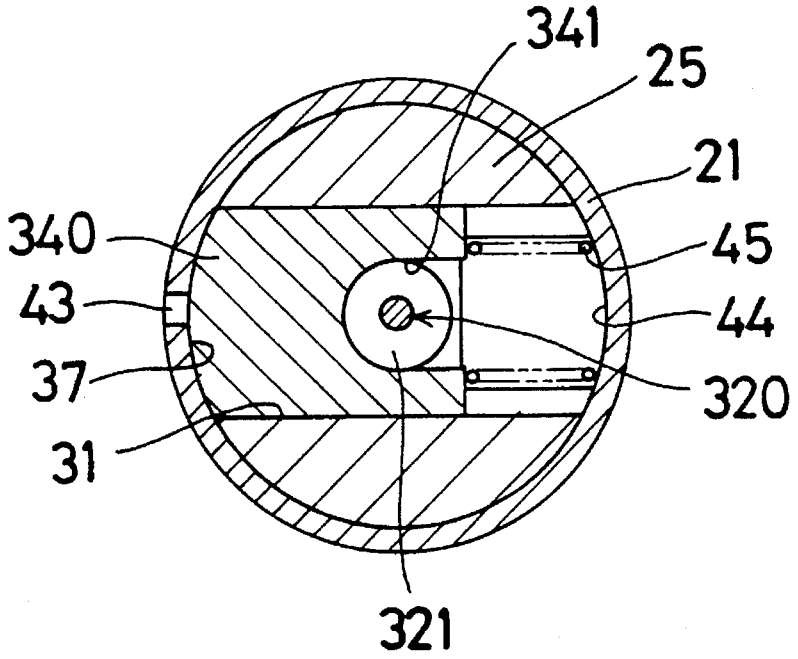
FIG. 9 is a cross-sectional view taken along the section line 9—9 in FIG. 8.
Figure 8:
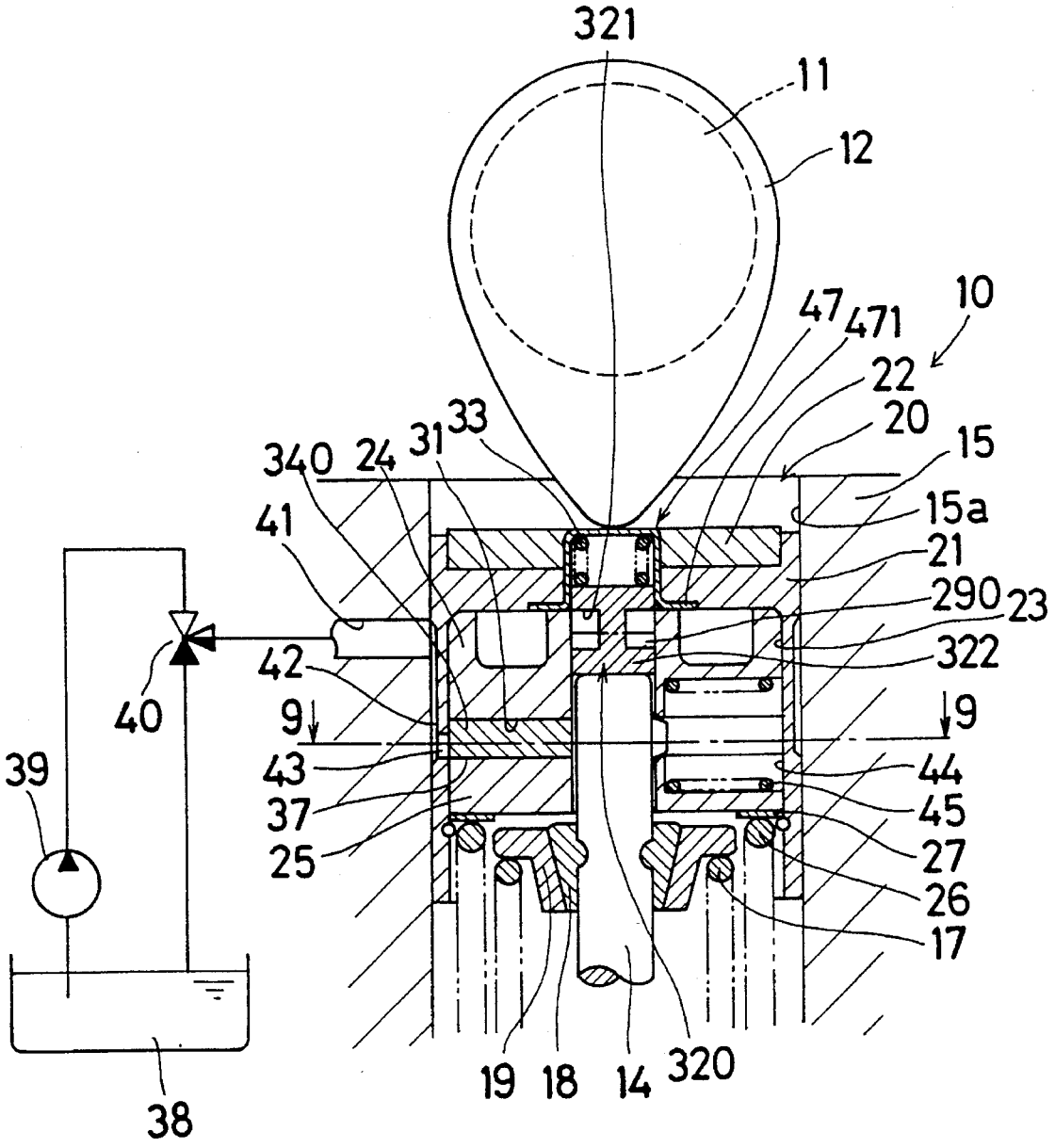
FIG. 8 is a cross-sectional view of the valve gear device shown in FIG. 6 wherein an intake and exhaust valve remains in its closed condition.

In the body bore 31, there is slidably fitted a plate 340, which is different in shape from the plate 34 of the first embodiment. That is, the plate 340 is provided at a right end thereof with a substantially U-shaped notch having a round bottom. When the plate 340 assumes a first position as shown in FIGS. 6 and 7 under which the round bottom is in an annular groove 321 formed in the main portion 322, the slider 320 engages the plate 340 as best seen in FIG. 6. As a result, movement of the slider 320 relative to the outer body 21 and inner bodies 24, 25 is prevented or restricted. On the other hand, when the plate 340 assumes a second position as shown in FIGS. 8 and 9 under which the round bottom is out of the annular groove 321, the slider 320 is out of engagement with the plate 340 as best seen in FIG. 8. As a result, movement of the slider 320 relative to the outer body 21 and inner bodies 24, 25 is permitted or allowed.

The second embodiment is identical with the first embodiment in operation and therefore an explanation of manner of operation of the second embodiment is omitted.

In the second embodiment, the top end of the retainer 47 is in line with the outer shim 22. Comparing such a structure with the corresponding portion of the first embodiment, it can be appreciated that an axial length of the valve controller 20 is reduced in the second embodiment.

It is to be noted that in the second embodiment, contact between the stem 14 and the plate 340 is avoided. Thus, the top end of the stem 14 can be free from partial or uneven frictional wear with the passage of time, thereby increasing the life of the stem 14.

Figure 10:
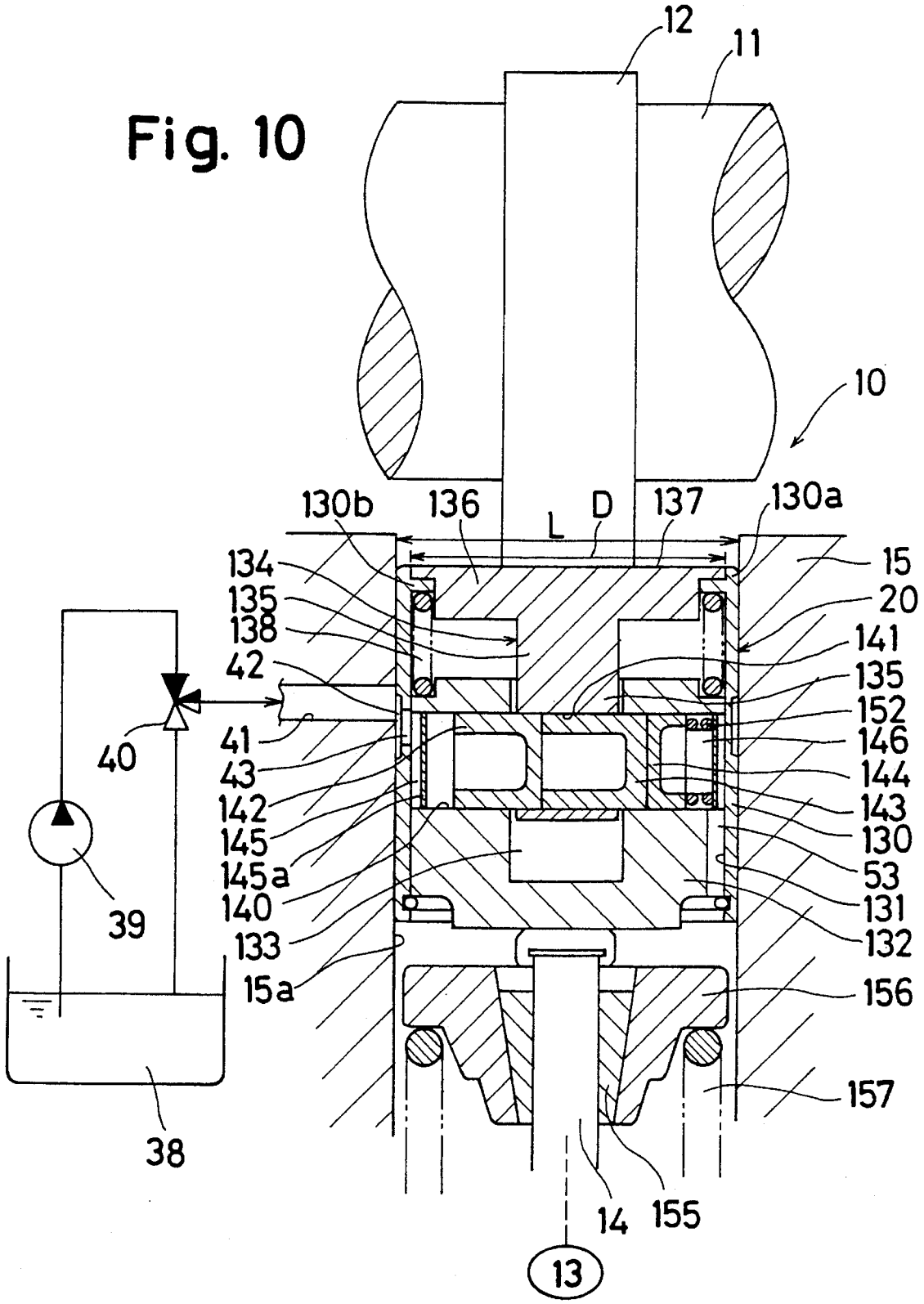
FIG. 10 is a cross-sectional view of a valve gear device in accordance with a third embodiment of the present invention.

Referring to FIG. 10 which illustrates a valve gear device 10 in accordance with a third embodiment of the present invention, a cam shaft 11 is provided with a cam 12. The cam 12 is in engagement with a valve control device 20 which is accommodated in a cylinder head 15 so as to be positioned between the cam 12 and an intake and exhaust valve 13. Thus, while the shaft 11 is being rotated, a force is transmitted from the cam 12 to the valve control device 20.

Figure 11:
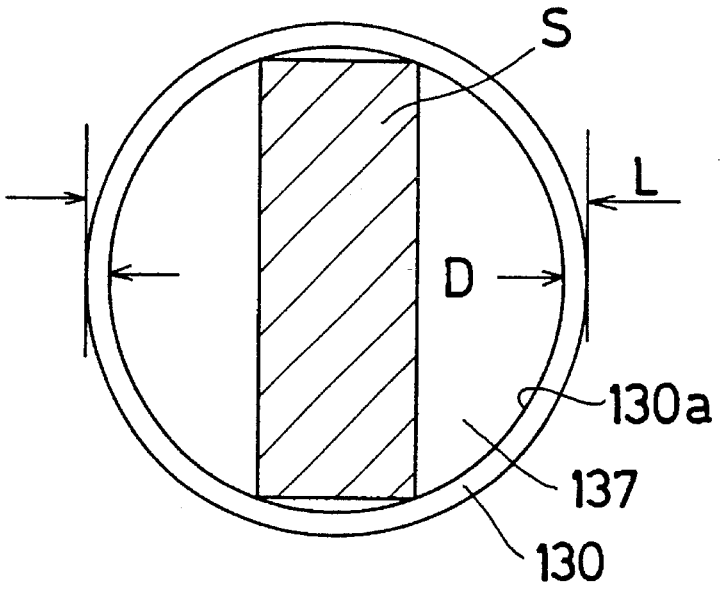
FIG. 11 is a plan view of a slider and a body.

Formed in the cylinder head 15 is a bore **15*a* in which is slidably fitted a cup-shaped first body 130. The first body 130 is provided with an opening 130*a* which opens toward the cam 12. As can be seen from FIG. 11, the diameter D of the opening 130*a* is slightly less than the diameter L of the first body 130**.

In the first body 130, there is formed an inner space 131 which is in fluid communication with the opening **130*a*. The first body 130 is also provided with an annular projection 130*b* which extends inwardly in the radial direction from an inner surface of the first body 130. In the inner space 131 of the first body 130, a second body 132 is slidably fitted and a bottom thereof is in engagement with a top end of a stem 14 which is connected to the intake and exhaust valve 13. The second body 32 is formed with a concave recessed portion 133** which opens in the upward direction.

A slider 134 is mounted in the inner space 131 of the first body 130 so as to be movable in the vertical direction or along an axial direction of the stem 14. The first body 130 and the slider 134 constitute a first member or first movable member 101. The second body 132 constitutes a second member or second movable member.

The slider 134 includes a projection 135 having a rectangular cross-section and a larger diameter portion 136 having an annular portion 137. The diameter of the annular portion 137 is identical with the diameter D of the opening **130*a*. The portion 137 is in engagement with the cam 12. The larger diameter portion 136 of the slider 134 rests on the annular projection 130*b* of the first body 130. Between the annular projection 130*b* and the second body 132 is interposed or disposed a spring 138 which urges the second body 132 in the downward direction or in the direction of the opening condition of the intake and exhaust valve 13**.

In the second body 132, there is formed a bore 140 which is perpendicular to the axis of the stem 14 (the intake and exhaust valve 13). A radial bore 141 is formed in the projection 135. The bore 141 is aligned with the bore 140 and is also perpendicular to the axis of the stem 14. The bore 140 and the bore 141 are identical with each other in opening shape. In the bore 140 are slidably fitted three pins 142, 143 and 144. The length of the pin 143 is identical with the width of both the concave portion 133 and the projection 135.

A pressure chamber 145 is defined in the bore 140 at the left side of the pin 142 and a spring chamber 146 is defined at the right side of the pin 144. The pressure chamber 145 is in fluid communication with a reservoir 38 via a passage 43, an annular groove 42, a passage 41 and a control valve 40. The pressure chamber 145 is also in fluid communication with a reservoir 38 via a passage 43, an annular groove 42, a passage 41, a control valve 40 which is in the form of an electromagnetic switching valve, and a pump 39. A spring 152 is disposed in the spring chamber 146 and urges the pins 142, 143, 144 in the leftward direction. It is to be noted that the pin 142 is brought into engagement with a wall **145*a* of the pressure chamber 145 and the pin 143 is brought into coincidence with the projection 135 of the slider 134 in the vertical direction. The pressure in the spring chamber 146 is relieved from a hole or passage 146**.

In the vicinity of the top end of the stem 14, a retainer 156 is mounted via a cotter 155. One end of a spring 157 is engaged with the retainer 156 for urging the stem 14 in the upward direction for establishing a closed condition of the intake and exhaust valve 13. The spring force or spring constant of the spring 157 is larger than that of the spring 138.

In operation, when engine operation is initiated, the cam shaft 11 and the cam 12 are brought into rotation. If it is desired that the intake and exhaust valve 13 be continually operated, the controller orders the control valve 40 to establish the condition shown in FIG. 10. Then, the pump 33 supplies fluid from the reservoir 38 to the oil chamber 145 via the passage 41, the groove 42 and the passage 43. The resultant fluid pressure moves the pins 142, 143 and 144 in the rightward direction against the biasing force of the spring 152. When the pin 142 bridges the bore 140 and the bore 141, the pin 143 also bridges the bore 140 and the bore 141. Thus, movement of the second body 132 relative to the slider 134 is prevented. Under such a situation, as a result of the proceeding rotation of the cam 12, when the portion 137 is brought into engagement with a nose of the cam 12 instead of a centric or circular portion thereof, the slider 134, the first body 130 and the second body 132 are moved in the downward direction. That is, so long as the portion 137 is in engagement with the nose of the cam 12, the resultant force is transmitted to the intake and exhaust valve 13 via the slider 134, the first body 130, the second body 132 and the stem 14, in that order. Depending on the shape of the nose or the profile of the cam 12, the intake and exhaust valve 13 is moved away from a seat (not shown) against the force of the spring 137, and intake operation or exhaust operation is established. At this time, even though the first body 130 or the slider 134 rotates relative to the cylinder bore 121, the engagement between the cam 12 and the portion 137 remains unchanged. This is due to the annular shaped structure of the portion 137.

Figure 12:
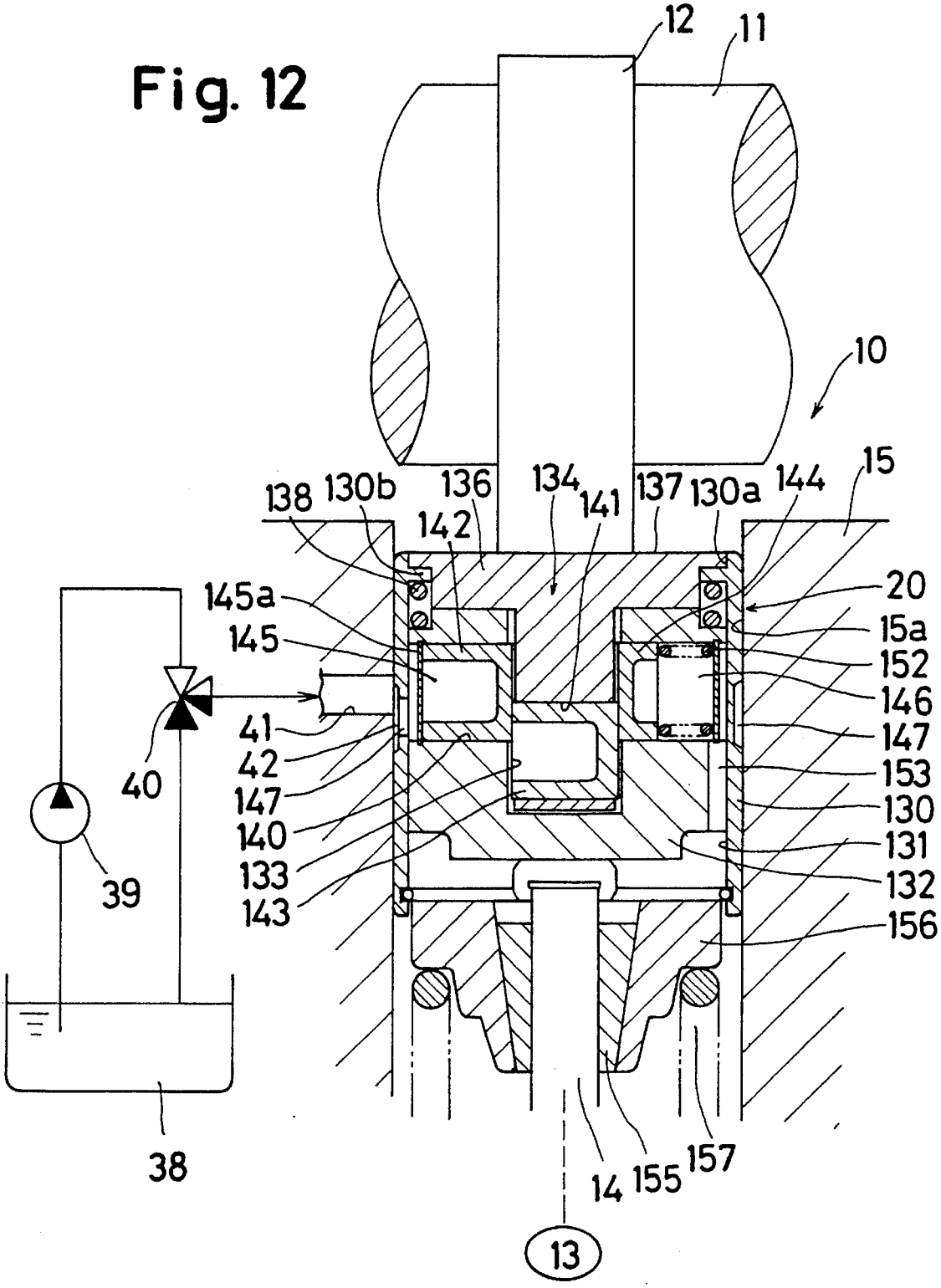
FIG. 12 is a cross-sectional view of the valve gear device shown in FIG. 10 wherein an intake and exhaust valve remains in its closed condition.

If it is desired that the intake and exhaust valve 13 not be operated while the cam 12 is being rotated, the controller orders the control valve 40 to establish the condition shown in FIG. 12. Then, the fluid in the oil chamber 140 is drained into the reservoir 38 via the passage 43, the groove 42 and the passage 41. Thus, due to the biasing force of the spring 152, the pins 142, 143 and 144 are, as a whole, moved in the leftward direction. As soon as the pin 143 is brought into vertical coincidence with the projection 135 of the slider 134, the slider 134 becomes movable in the concave portion 133 of the second body 132. The resultant condition enables movement of the slider 134 (the first body 130) relative to the second body 132. Thus, even when the portion 137 is brought into engagement with the nose of the cam 12 instead of the centric or circular portion thereof, the force from the cam 12 is transmitted to only the slider 134 and the first body 130 and is not transmitted to the stem 14. This means that no force transmission from the cam 12 to the intake and exhaust valve 13 occurs and the closed condition of the intake and exhaust valve 13 is maintained so that no operation thereof is established. Under such a condition, even though the portion 137 rotates relative to the cylinder bore 121, the engagement between the cam 12 and the portion 137 remains unchanged. This is due to the annular shaped structure of the portion 137.

It is to be noted that in the third embodiment, contact between the stem 14 and the second body 132 is avoided. Thus, the top end of the stem 14 is free from partial or uneven frictional wear over the passage of time, which enables an increase in the life of the stem 14.

Figure 15:
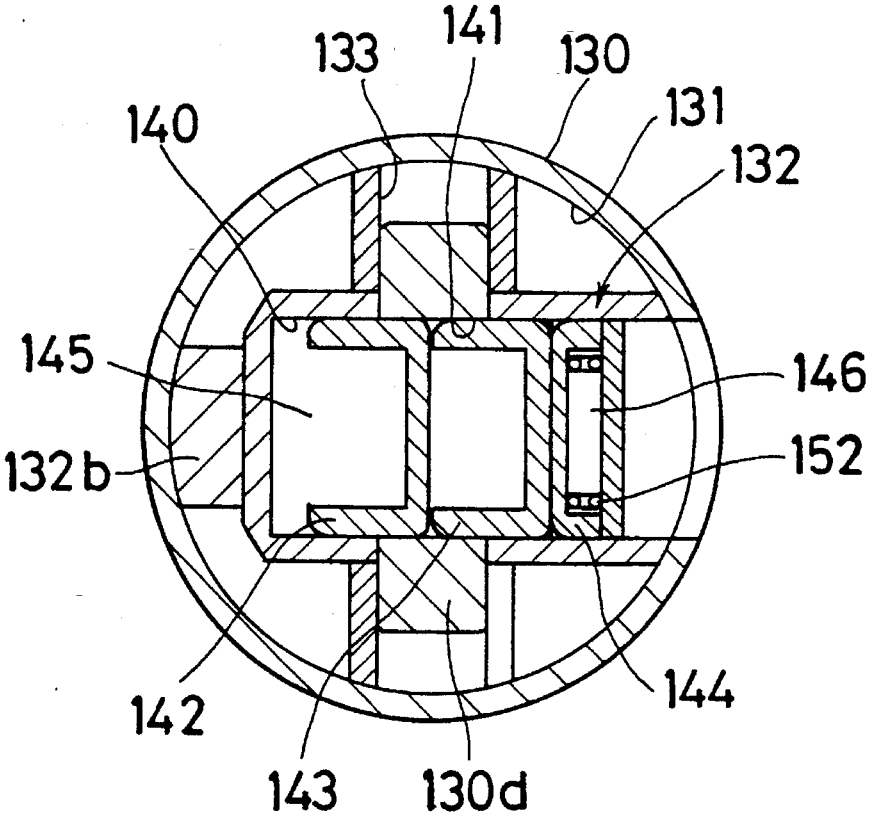
FIG. 15 is a cross-sectional view taken along the section line 15—15 in FIG. 13.
Figure 13:
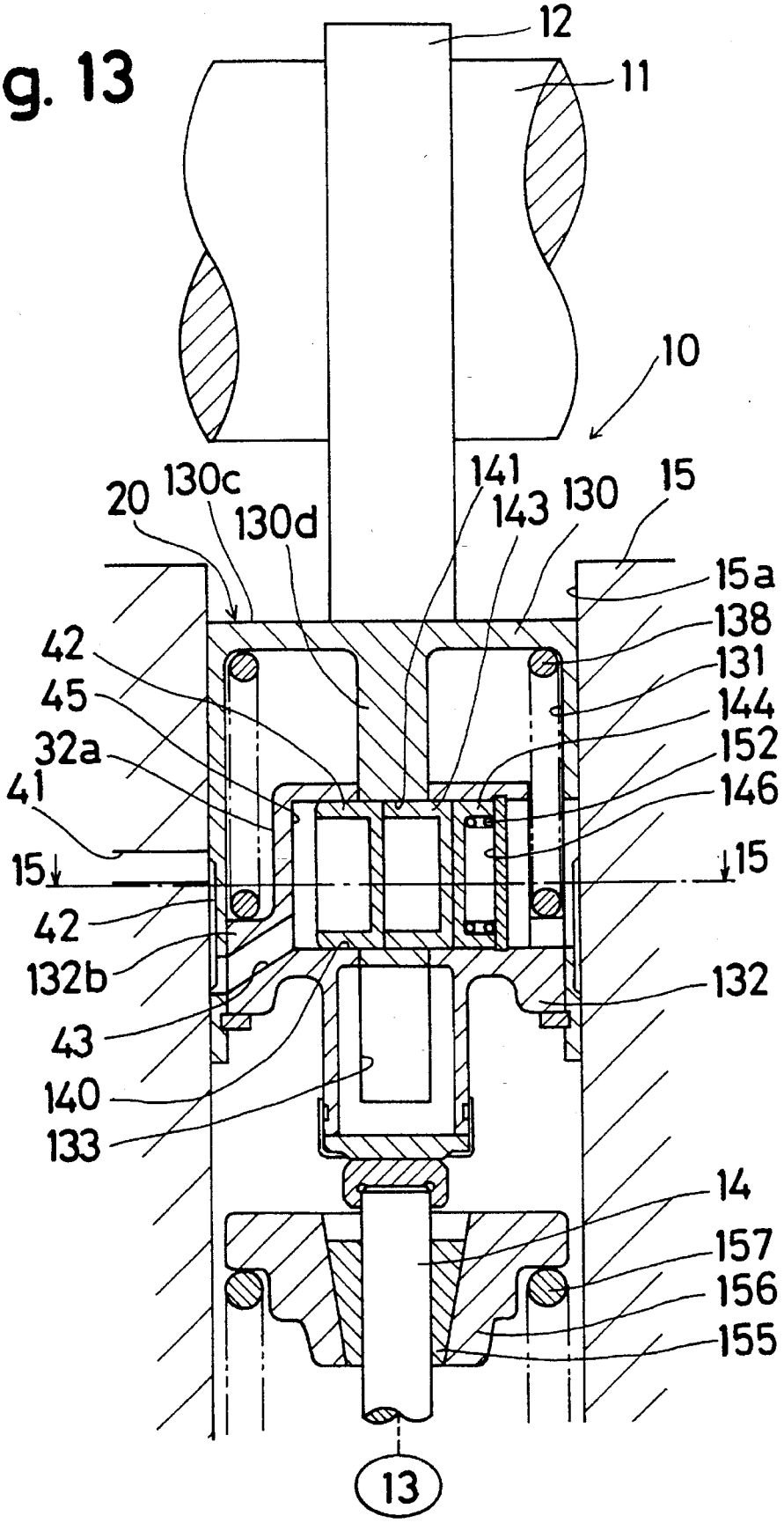
FIG. 13 is a cross-sectional view of a valve gear device in accordance with a fourth embodiment of the present invention.
Figure 14:
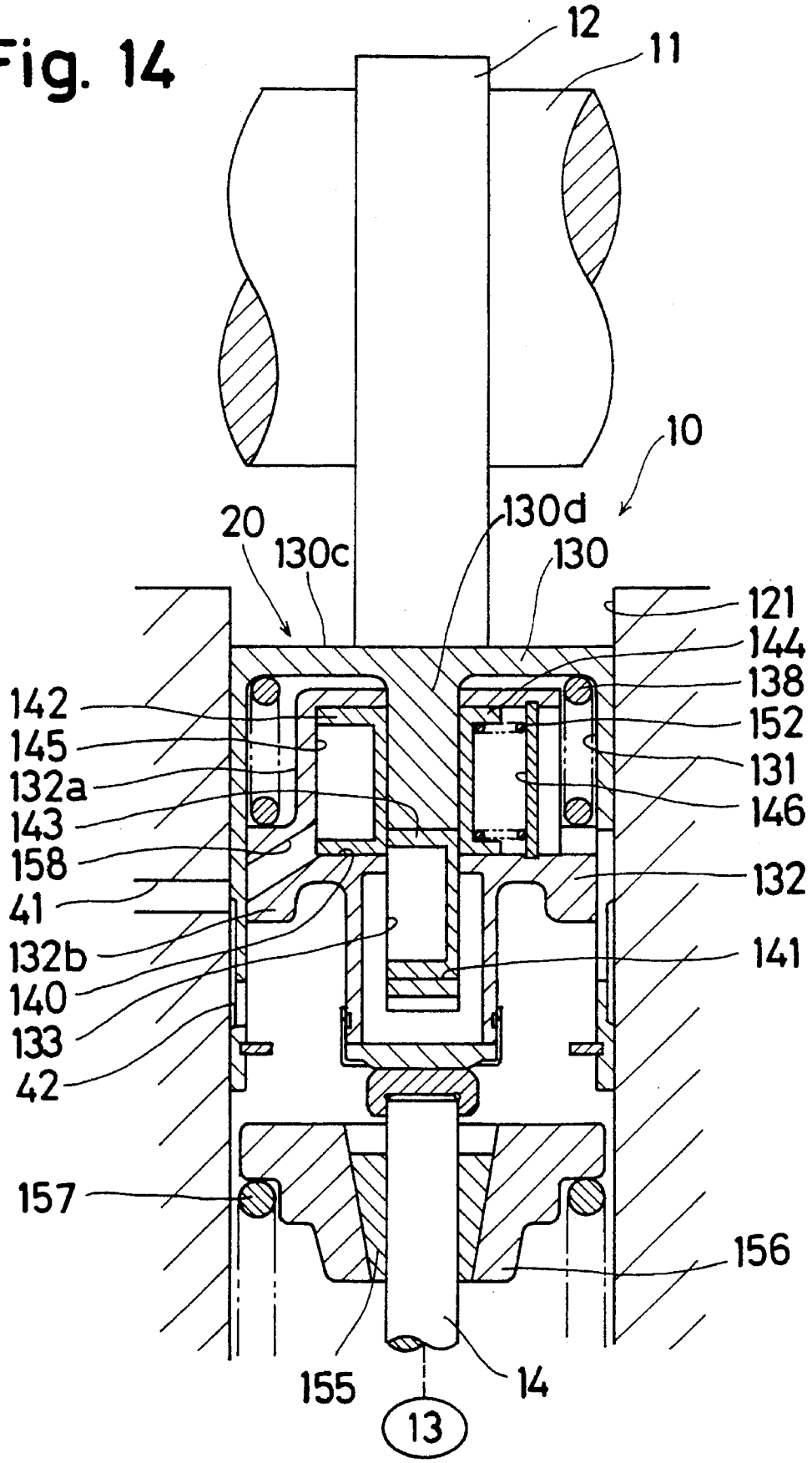
FIG. 14 is a cross-sectional view of the valve gear device shown in FIG. 13 wherein an intake and exhaust valve remains in its closed condition.

In FIGS. 13 through 15, there is illustrated a fourth embodiment of the present invention. The feature of the fourth embodiment that differs from the third embodiment is that the first body 130 and the slider 134 depicted in the third embodiment are integrated into a first body 130 in the fourth embodiment.

Figure 16:
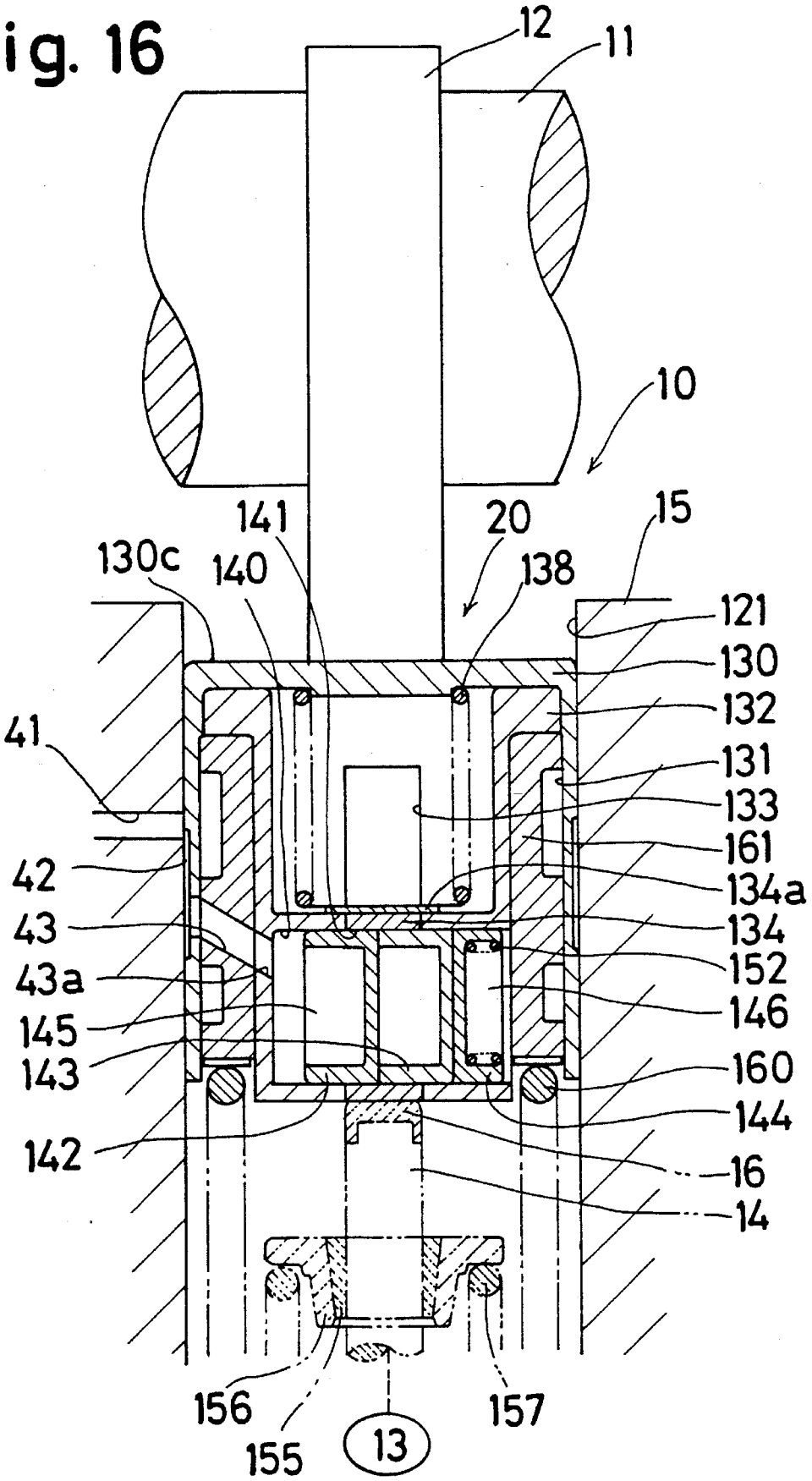
FIG. 16 is a cross-sectional view of a valve gear device in accordance with a fifth embodiment of the present invention.
Figure 17:
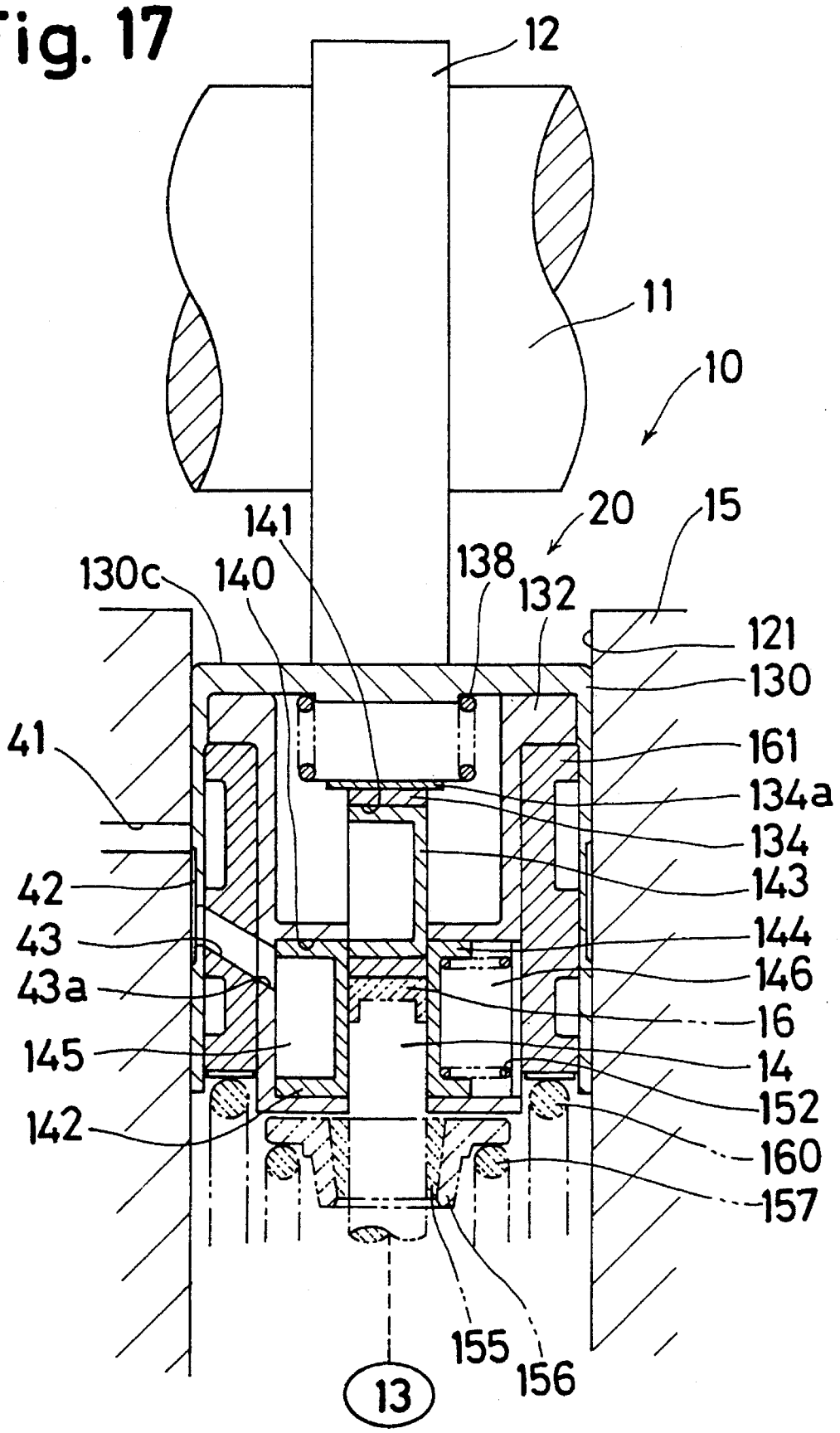
FIG. 17 is a cross-sectional view of the valve gear device shown in FIG. 16 wherein an intake and exhaust valve remains in its closed condition.

Referring to FIGS. 16 and 17 which illustrate a fifth embodiment of the present invention, a first body 130 is slidably fitted in a bore 121 and has an upper top end portion **130*c* formed into an annular shaped structure. The first body 130 has an inner space 131 in which a second body 132 is fitted. The first body 130 and the second body 132 are connected to each other by a member 161 which is urged by a spring 160 such that the second body 132 is held between the member 161 and the first body 130. This establishes unitary movement of the first body 130 and the second body 132. The member 61 is made of a light-weight material such as aluminum. The second body 132 and the member 161 are formed with a passage 43 and 43*a***, respectively, which are in fluid communication with each other.

The second body 132 has a guide bore 133 which opens in the downward direction and in which a slider 134 is slidably fitted. The slider 134 is in engagement with a cap 16 mounted on a stem 14 of an intake and exhaust valve 13. The slider 134 is urged by a spring 138 in the direction of opening of the intake and exhaust valve 13. The slider 134 has a bore 141 in which one or all of several pins 142 and 143 are slidably fitted.

A flange **134*a* is formed at an upper portion of the slider 134. Engagement of the flange 134*a* with the second body 130 prevents the slider 134 from dropping through the guide bore 133. The top end of the stem 14 equipped with the cap 16 is biased by a spring 157** in the upward direction.

In operation, when engine operation is initiated, the cam shaft 11 and the cam 12 are brought into rotation. If the intake and exhaust valve 13 is desired to be operated continually, a controller (not shown) establishes the condition shown in FIG. 16 by introducing a fluid pressure into an oil chamber 145 via the passage 41, the groove 42, the passage **43*b* and the passage 43*a*. The resultant fluid pressure moves the pins 142, 143, 144 in the rightward direction against the biasing force of a spring 152. When the pin 142 bridges the bore 140 and the bore 141, the pin 143 also bridges the bore 140 and the bore 141. Thus, any movement of the second body 132 relative to the slider 134** is prevented.

Under such a situation, as a result of the proceeding rotation of the cam 12, when the portion **130*c* is brought into engagement with a nose of the cam 12 instead of a centric or circular portion thereof, the slider 134, the first body 130 and the second body 132 are moved in the downward direction. That is, so long as the portion 130*c* is in engagement with the nose of the cam 12, the resultant force is transmitted to the intake and exhaust valve 13 via the first body 130, the second body 132, the pins 142, 143, the slider 134 and the stem 14, in that order. Depending on the shape of the nose or the profile of the cam 12, the intake and exhaust valve 13 is moved away from a seat (not shown) against the spring 157 and the intake operation or exhaust operation is established. At this time, even though the first body 130 of the slider 134 rotates relative to the cylinder bore 121, the engagement between the cam 12 and the portion 130*c* remains unchanged. This is due to the annular shaped structure of the portion 130*c***.

If it is desired that the intake and exhaust valve 13 not be operated while the cam 12 is being rotated, the controller establishes the condition in FIG. 17 by draining the fluid pressure in the oil chamber 140. Thus, as a result of the biasing force of the spring 152, the pins 142, 143, 144 are, as a whole, moved in the leftward direction. As soon as the pin 143 is accommodated perfectly in the bore 141 of the slider 134, the slider 134 becomes movable in the bore 133 of the second body 132. The resultant condition enables movement of the first body 130 (the second body 132) relative to the slider 134. Thus, even when the portion 130*c* is brought into engagement with the nose of the cam 12 instead of the centric or circular portion thereof, the force from the cam 12 is transmitted to only the first body 130 and causes only the movement of the first body 130 so that the slider 134 remains unchanged. This means that no force transmission from the cam 12 to the intake and exhaust valve 13 occurs, thereby enabling the closed condition of the intake and exhaust valve 13 to be maintained. Under such a condition, even though the portion 130*c* rotates relative to the cylinder bore 121, the engagement between the cam 12 and the portion 130*c* remains unchanged. This is due to the annular shaped structure of the portion 130*c*. In this embodiment, no member is in sliding engagement with the top end of the stem 14. Thus, the wear of the stem can be prevented.

Referring to FIGS. 18 through 21, there is illustrated a sixth embodiment of the present invention. In this embodiment, a pair of axially spaced cams 12, 12 are provided on a shaft 11 and an annular groove 12*a* which is of a constant width is defined between the cams 12, 12. As will be described in more detail below, a retainer 62 is fitted into the groove 12*a*.

In a bore 121 is slidably fitted a first body 130 on which an outer shim 163 is mounted. The shim 163 serves for adjusting a clearance between the cam 12 and a valve control device 20. The radius of the shim 163 is slightly less than the radius of the bore 121. The retainer 162 has a top end 162*a* and a flange 162*b*. The top end 162*a* extends into the groove 12*a* after being passed through the first body 130 and the shim 163. The radius of the top end 162*a* is slightly less than the width of the groove 12*a*. The flange 162*b* is fixedly held between the first body 130 and an inner body 132.

Figure 18:
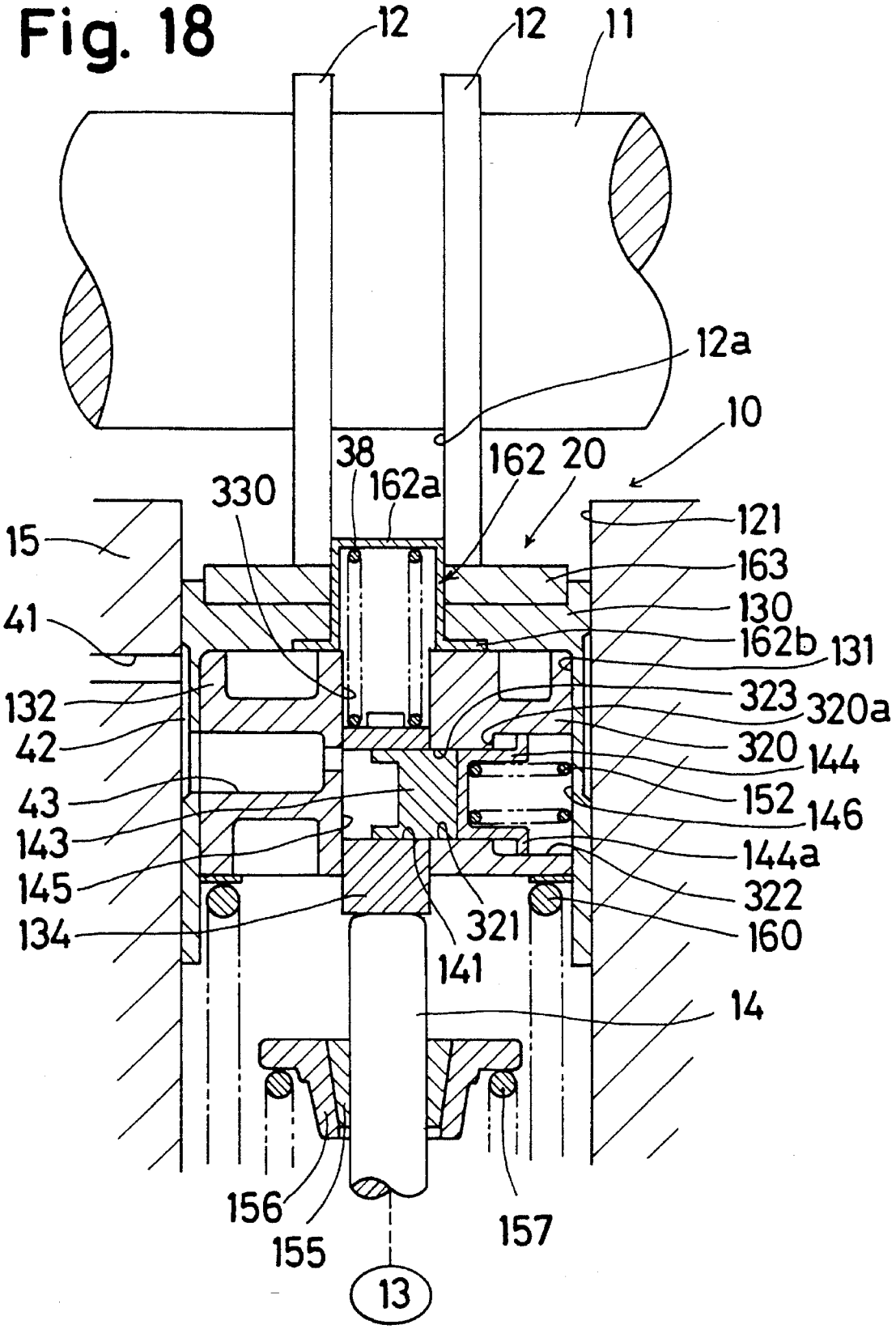
FIG. 18 is a cross-sectional view of a valve gear device in accordance with a sixth embodiment of the present invention.
Figure 19:
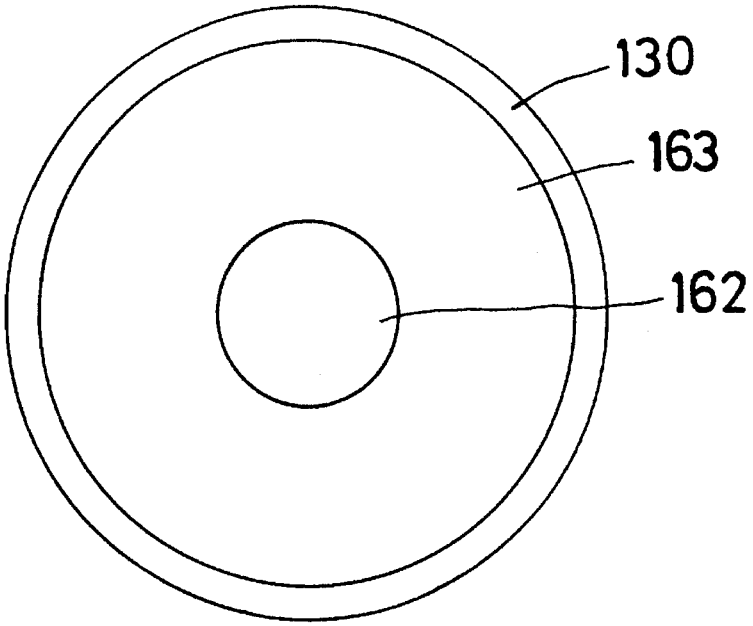
FIG. 19 is a plan view of a valve control device in the valve gear device shown in FIG. 18.
Figure 21:
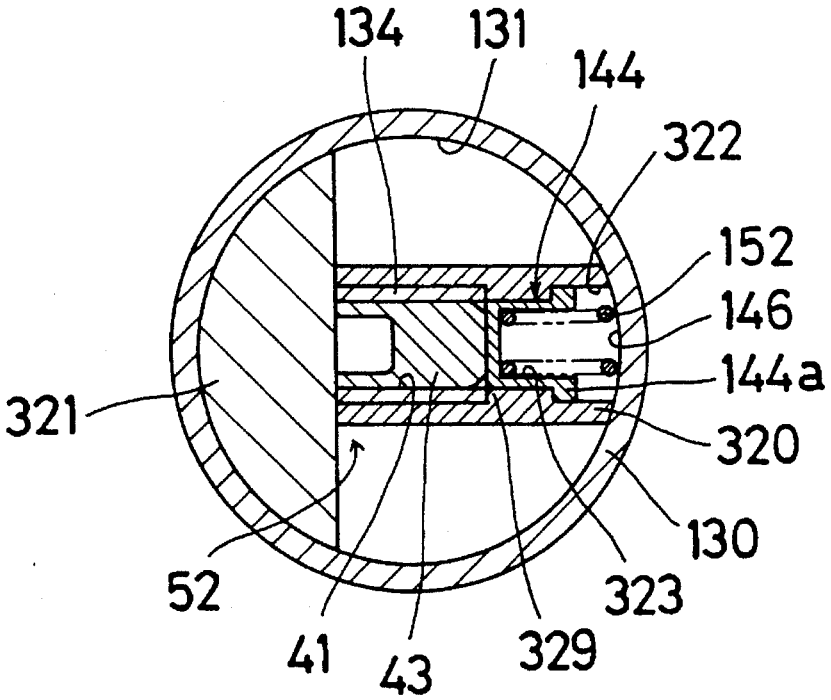
FIG. 21 is a cross-sectional view taken along the section line 21—21 in FIG. 20.

As shown in FIGS. 18 and 21, within an inner space 131 of the first body 130, the inner body 132 including a first portion 320 and a second portion 321 is accommodated and is set to be movable together with the first body 130. Defined between the first portion 320 and the second portion 321 is a bore 330 which is of a substantially rectangular shape in cross-section. A spring 160 urges the first portion 320 and the second portion 321 in the direction of closure of an intake and exhaust valve 13.

A slider 134 is slidably fitted in the bore 330 and is in continual engagement with a top end of a stem 14 of the intake and exhaust valve 13. A spring 138 is disposed between the slider 134 and the top portion 162*a* of the retainer 162. Thus, the slider 134 is biased by the spring 138 toward the opening direction of the exhaust valve 13. It is to be noted that the biasing force of the spring 138 is less than that of the spring 160.

A body bore 321 is defined in the inner body 132 so as to extend perpendicular to the axis of the stem 14 and has a larger portion 322 and a smaller portion 323. In the slider 134 is formed a slider bore 141 which extends perpendicular to the axis of the stem 14. The body bore 321 is in alignment with the slider bore 141 and is identical in radius.

A first pin 143 is slidably fitted in the slider bore 141 and the body bore 321, and a second pin 144 is slidably fitted in the body bore 321. An oil chamber 145 is defined between the pin 143 and the inner body 132, and is supplied with a fluid pressure via a passage 41, a groove 42 and a passage 43. The pin 143 is movable together with the slide 134 in the vertical direction when the pin 143 is perfectly accommodated in the slider 134.

A spring chamber 146 is defined between the pin 144 and the first body 130, and a spring 152 disposed in the spring chamber 146 urges the pin 144 in the leftward direction. The pin 144 has a flange 144*a* and when the flange 144*a* engages a stepped portion 320*a* of the inner body 132 the flange 144*a* is coplanar with the slider bore 330 as shown in FIG. 20.

In operation, when engine operation is initiated, the cam shaft 11 and the cams 12 are brought into rotation. If the intake and exhaust valve 13 is desired to be operated continually, a controller (not shown) establishes the condition shown in FIG. 18 by introducing a fluid pressure into the oil chamber 145 via the passage 41, the groove 42, the passage 43 and a passage 158. The resultant fluid pressure moves the pins 143 and 144 in the rightward direction against the biasing force of a spring 152. When the pin 143 bridges the bore 321 and the bore 141, movement of the first body 130 (inner body 132) relative to the slider 134 is prevented. Under such a situation, as a result of the proceeding rotation of the cam 12, when the shim 163 is brought into engagement with a nose of the cam 12 instead of a centric or circular portion thereof, the first body 130 and the slider 134 are moved in the downward direction. That is, so long as the shim 163 is in engagement with the nose of the cam 12, the resultant force is transmitted to the intake and exhaust valve 13 via the first body 130, the inner body 132, the pin 143, the slider 134 and the stem 14, in that order. Depending on the shape of the nose or the profile of the cam 12, the intake and exhaust valve 13 is moved away from a seat (not shown) against the force of the spring 157, and intake operation or exhaust operation is established. At this time, even though the first body 130 or the slider 134 rotates relative to the cylinder bore 121, the engagement between the cam 12 and the portion 130*c* remains unchanged. This is due to the annular shaped structure of the retainer 62.

Figure 20:
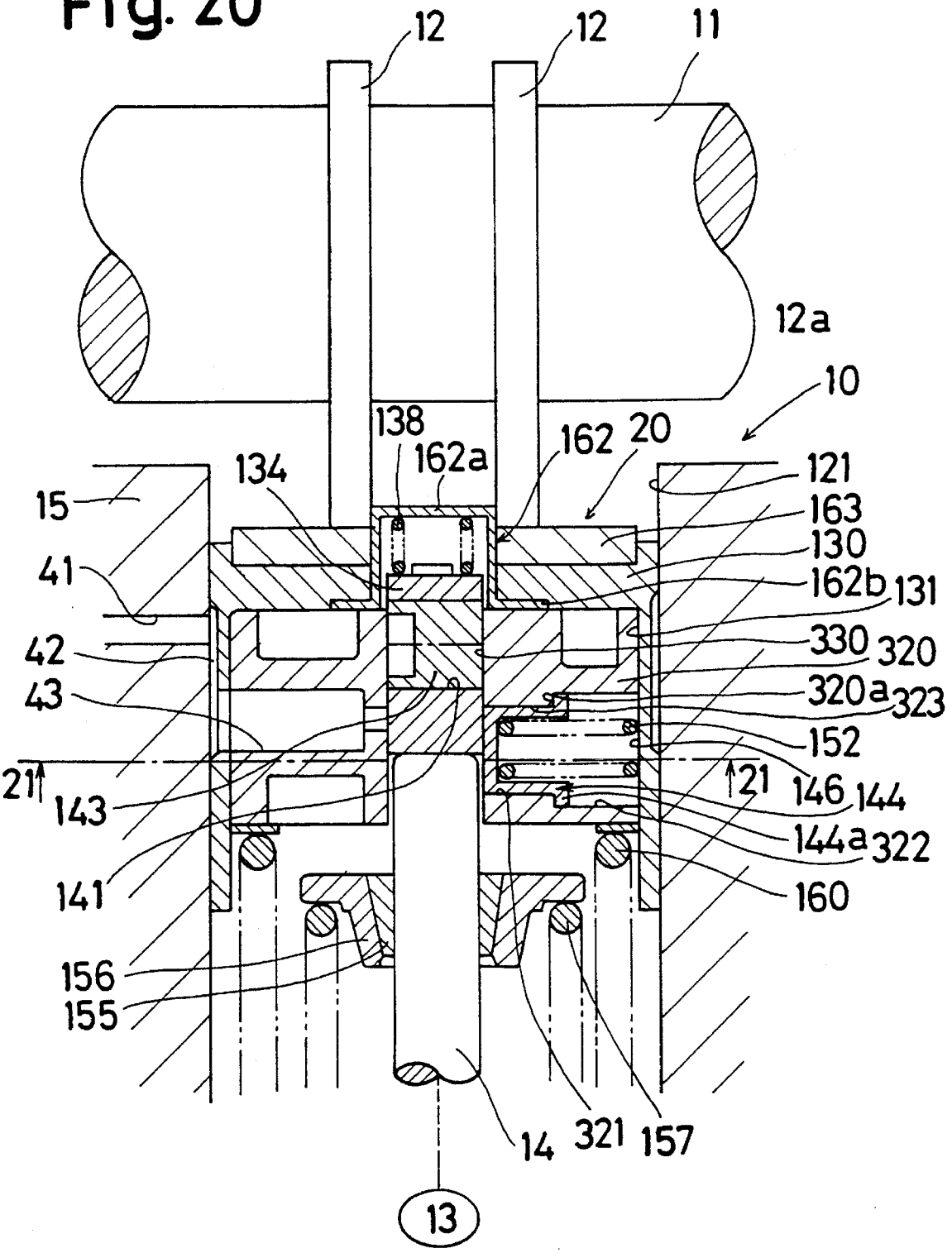
FIG. 20 is a cross-sectional view of the valve gear device shown in FIG. 18 wherein an intake and exhaust valve remains in its closed condition.

If it is desired that the intake and exhaust valve 13 not be operated while the cam 12 is being rotated, the controller establishes the condition in FIG. 20 by draining the fluid pressure in the oil chamber 145. Thus, due to the biasing force of the spring 152, the pins 143 and 144 are, as a whole, moved in the leftward direction. As soon as the pin 143 is accommodated perfectly in the slider 134, the slider 134 becomes movable in the bore 330. The resultant condition enables movement of the first body 130 (the inner body 132) relative to the slider 134. Thus, even when the portion 130*c* is brought into engagement with the nose of the cam 12 instead of the centric or circular portion thereof, the force from the cam 12 is transmitted to only the first body 120 and causes only movement of the first body 130 so that the slider 134 remains unchanged. This means that no force transmission from the cam 12 to the intake and exhaust valve 13 occurs so that the closed condition of the intake and exhaust valve 13 is maintained. Under such a condition, even though the first body 130 rotates relative to the cylinder bore 121, the engagement between the cam 12 and the shim 163 remains unchanged. This is due to the annular shaped structure of the retainer 162. In this embodiment, since no member is in sliding engagement with the top end of the stem 14, the wear of the stem 14 is prevented.

The principles, preferred embodiments and modes of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A valve gear device comprising:

a stem having a first end and an oppositely positioned second end;

an intake and exhaust valve connected to the second end of the stem for opening and closing a port formed in a cylinder head of an internal combustion engine;

a first spring biasing the stem toward a closing condition of the intake and exhaust valve;

a cam; and a valve control device positioned between the cam and the first end of the stem, the valve control device including a first member slidably positioned in a bore in the cylinder head for movement along an axis of the stem, said first member being operationally associated with the cam so that rotation of the cam causes sliding movement of the first member, a second member operatively associated with the first end of the stem, said second member being movable within and relative to the first member, said second member including a slider that is comprised of a main portion and a stem guide that receives the first end of the stem, said main portion having an outer surface provided with an annular groove; and a regulating member disposed in the bore of the cylinder head and movable between a first position in which movement of the second member relative to the first member is permitted and a second position in which movement of the second member relative to the first member is prevented, said regulating member including a movable plate having a through hole provided therein, the plate being movable between said second position in which the through hole in the plate is out of coaxial alignment with the stem guide to prevent relative movement between the slider and the first member and said first position in which the through hole in the plate is coaxially aligned with the stem guide to permit relative movement between the slider and the first member.

2. A valve gear device in accordance with claim 1, wherein the regulating member is movable in a direction perpendicular to the axis of the stem.

3. A valve gear device in accordance with claim 1, including a constant pressure chamber positioned on one side of the regulating member for applying a constant pressure to the regulating member and a variable pressure chamber positioned on an opposite side of the regulating member for applying a variable pressure to the regulating member.

4. A valve gear device in accordance with claim 3, wherein the variable pressure chamber is connected to a fluid pressure source for applying the variable pressure to the regulating member, and the constant pressure chamber has a spring disposed therein for applying the constant pressure to the regulating member.

* * * * *